US005913622A

United States Patent [19]

Bradfield et al.

[11] Patent Number: 5,913,622

[45] Date of Patent: Jun. 22, 1999

[54] CLUTCH FOR ROTATIONAL SYNCHRONIZATION BETWEEN INPUT AND OUTPUT ELEMENTS OF A PRINTER DURING ENGAGEMENT/DISENGAGEMENT CLUTCH CYCLES

[75] Inventors: Gerald A. Bradfield, Waynesboro; James L. Harlow, Mt. Solon, both of Va.

[73] Assignee: Genicom Corporation, Chantilly, Va.

[21] Appl. No.: 08/777,120

[22] Filed: Dec. 30, 1996

[51] Int. Cl.[6] ..... B41J 11/50

[52] U.S. Cl. ..... 400/605; 400/608.1

[58] Field of Search ..... 400/605, 608.1, 400/608.2, 342, 616, 616.1, 616.2

[56] References Cited

U.S. PATENT DOCUMENTS 5,051,010 9/1991 Stephens et al. ..... 400/194

*Primary Examiner*—Edgar Burr
*Assistant Examiner*—Anthony H. Nguyen
*Attorney, Agent, or Firm*—Nixon & Vanderhye

[57] ABSTRACT

In a printer having multiple paper paths, each path is provided with a clutch and a tractor to advance paper between a printhead and a striker bar, the paper being selectively advanced along the paper paths. Each clutch has a timing pulley driven by a cog belt, in turn driven by a stepper motor. The input pulley and the output gear driving the tractor are synchronized during repeated engagement such that the clutch reengages the input and output elements at a rotational position corresponding to the rotational position of the input element when previously disengaged from the output element.

6 Claims, 4 Drawing Sheets

CLUTCH FOR ROTATIONAL SYNCHRONIZATION BETWEEN INPUT AND OUTPUT ELEMENTS OF A PRINTER DURING ENGAGEMENT/DISENGAGEMENT CLUTCH CYCLES

TECHNICAL FIELD

The present invention relates generally to a clutch system enabling synchronization between rotational input and output elements during repeated disengagement and engagement cycles and particularly relates to a clutch mechanism for a printer having two or more paper paths and methods of operating the printer to enable synchronization between a stepper motor under control of a controller and the paper whereby misregistration of paper through the printer is eliminated.

BACKGROUND

High-speed paper printers are, of course, well known. To increase paper handling capability and afford flexibility in paper handling, printers have been provided with multiple paper paths for feeding different types of paper through the printer for different purposes without the necessity of manually removing one type of paper from the printer in order to feed a different type of paper. A printer of this type is described and illustrated in U.S. Pat. No. 5,051,010, of common assignee herewith. In that printer, a plurality of paper paths are provided through the printer, with at least two of the paper paths having a tractor with sprockets for engaging marginal holes along the paper to drive the paper through the printer. Another paper path is provided for printing cut paper. Thus, it becomes necessary in serial dot matrix impact printers of that type with co-resident paper paths to park the paper not currently being printed while printing paper from another path. Clutches are typically used to control the movement of the paper along the various paper paths. Prior printers, however, use clutches that can lose synchronization between the input and output elements when they are disengaged. Upon reengagement, the input rotational element cannot be guaranteed to be at the same rotational angle with respect to the output rotational element prior to disengagement. Maintaining synchronization is of particular importance in maintaining vertical paper position accuracy in the printer, especially during repeated disengagement/reengagement cycles as is the case in multiple paper path printers.

As a specific example, paper may be parked along one of the paper feed paths with the clutch driving the tractor for that paper path disengaged. The clutch for another paper path remains engaged and paper is fed therealong through the printer. However, when the clutch for driving the paper along the one paper path is disengaged, mechanical synchronization between the software operating the printer and the paper in the one path is lost. Similarly, when the clutch for the other paper path is disengaged, synchronization between the software and the paper being driven through the other paper path is lost. In other words, when the clutch in any paper path is disengaged, the link between the paper in that path and the software controlling printer operations is broken. The software does not know the location of the paper parked along the one path when the printer returns to feed paper along that one path. Absent synchronization, it is not infrequent that after multiple engagements and disengagements of the clutches, the printing on the paper will be offset from the desired printing locations on the paper and may possibly print close to or along perforation lines where the paper is to be torn into discrete sheets.

Additionally, where automatic paper shearers are provided on printers of this type, these shearers are oftentimes misregistered with the desired cut lines along the paper, resulting in discrete paper sheets cut too close to the print or even through the print. That is, vertical paper misregistration can be aggravated using previous clutches in printers equipped with paper shearing features where paper from each path is repeatedly sheared and parked. Each time paper is sheared, a new edge is formed. Attempts to sense the paper, for example, optically or by a microswitch, often fail because inaccuracy in the sheared edge will cause the paper to be sensed at a different point. Each time a new paper edge is sensed, an error can occur. These errors are cumulative and eventually can cause gross vertical paper misregistration.

DISCLOSURE OF THE INVENTION

According to the present invention, there is provided a printer having multiple paper paths wherein synchronization is achieved between an input rotational element, for example, the pulley of a clutch driven by a timing belt and stepper motor under control of a controller and an output rotational element, for example, a hub driving an output gear for driving the paper feed device such as a tractor, during repeated engagement/disengagement cycles of the clutches for feeding paper through the different paper paths. To accomplish this, the present invention provides a discrete clutch for each paper feed device for feeding paper along each path through the printer wherein the rotational input element to the clutch, i.e., the pulley, is reset prior to clutch engagement to a rotational position corresponding to the rotational position of the input element when it was previously disengaged from the output element. Consequently, with the controller remembering the step position of the stepper motor when the clutch was disengaged, the controller may return the stepper motor and, hence, the rotational input element to a position corresponding to the position of the stepper motor and rotational element when the clutch was disengaged. By providing preferably two teeth on the rotatable input element 180° apart and preferably two recesses on the output rotational element, likewise 180° apart, there are only two possible relative rotatable angular positions at which the clutch can engage and disengage, thus eliminating all other possibilities. With the controller storing in electronic memory the position of the stepper motor when the clutch is disengaged, the stepper motor controller can return the stepper motor to the previous position where the clutch was disengaged.

In a specific form of the present invention, the clutch may comprise a hub, a pulley, an output shaft and gear, a solenoid and a leaf spring. The pulley is intermittently rotated during printer operations by a timing belt driven by the stepper motor. The hub is connected to the output shaft and output gear and is slidable axially on the shaft into positions in engagement and out of engagement with the pulley. The leaf spring biases the pulley into a position out-of-engagement with the hub. A solenoid on the clutch is coupled by a flexible element to the leaf spring to displace the leaf spring against its bias and simultaneously displace the hub into engagement with the pulley whereby the pulley drives the output gear. Consequently, when the hub is engaged with the pulley, torque is transmitted from the stepper motor through the pulley to the hub and to the output shaft and gear to drive the paper feed device. By this arrangement, synchronization between the stepper motor, hence, controller, and the paper feed, i.e., paper position, is achieved without cumulative error in the system.

To compensate for slight misalignment due to small movements, for example, an angular degree or two of the clutch hub and guarantee engagement to the previous rotational position, the stepper motor, under control of the controller, will position the pulley a few angular degrees behind the corresponding position where the clutch was disengaged before the controller energizes the solenoid to engage the clutch. Once the solenoid is energized and the stepper motor drives the pulley forwardly, the pulley will advance until the teeth align with the recesses and the hub engages the pulley. At that point, the clutch is engaged and the controller is synchronized with the position of the paper in the feed path.

In a preferred embodiment according to the present invention, there is provided a method of operating a printer having at least two paper paths, comprising the steps of providing a clutch having rotational input and output elements, repeatedly engaging and disengaging the input and output elements relative to one another for respectively feeding and discontinuing the feed of paper along one of the paths and synchronizing the input and output rotational elements during repeated engagement thereof such that the clutch reengages the input and output elements at a rotational position corresponding to the rotational position of the input element when previously disengaged from the output element.

In a further preferred embodiment according to the present invention, there is provided a printer comprising a printer housing having a printhead and at least two paper paths for selectively feeding paper in the paper paths to the printhead, a drive mechanism for feeding paper along one of the paths, including a stepper motor, a timing belt driven by the stepper motor, a clutch coupled to the timing belt, and a paper-engaging feed device coupled to the clutch, the clutch being operable in a clutch-engaged position to drive the paper-engaging feed device to feed paper along the one paper path in response to rotation of the stepper motor, and in a clutch-disengaged position precluding the stepper motor and timing belt from driving the paper-engaging feed device, a clutch actuator for engaging and disengaging the clutch, a controller for the stepper motor including a memory for remembering stepper motor rotational positions upon disengagement of the clutch and repositioning the stepper motor to a position enabling engagement of the clutch at the same rotational position of the stepper motor when the clutch was disengaged, thereby synchronizing the stepper motor and the position of the paper along the one path.

Accordingly, it is a primary object of the present invention to provide a novel and improved method and apparatus for achieving synchronization between input and output rotational elements of discrete clutches coupled to paper feed devices in discrete paper paths whereby the printer controller and paper location are synchronized.

BEST MODE FOR CARRYING OUT THE INVENTION

Figure 1:
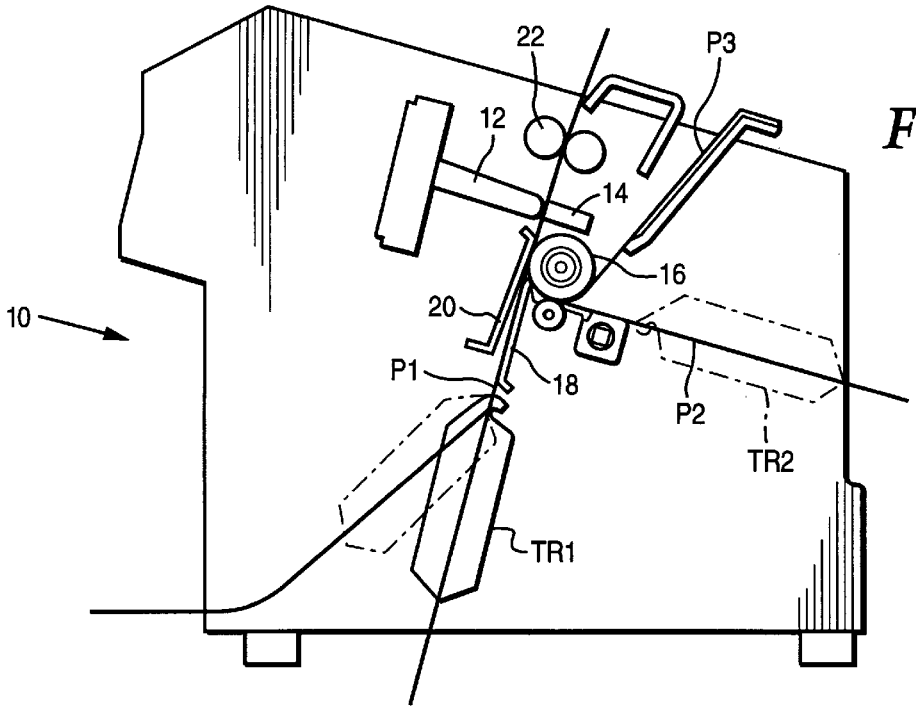
FIG. 1 is a schematic illustration of a printer illustrating a plurality of paper paths through the printer.

Referring to FIG. 1, there is schematically illustrated a printer, generally designated 10, having a printhead 12, a striker bar 14 opposite the printhead 12, and a main paper drive roller 16 which cooperates with a printer pan 18 and a flat paper pinching spring 20 to drive the paper through the printhead and striker bar 12 and 14, respectively. A pair of exit pinch rollers 22 are provided downstream of the printhead for engaging the printed paper and discharging the paper from printer 10. As illustrated, printer 10 has a plurality of paper paths, three discrete paper paths being illustrated. For example, a first paper path P1 is provided for feeding paper continuously through a bottom or front paper inlet feed opening, along the flat side of paper pan 18 and past the main drive roller 16 for printing by printhead 12 and exit from the printer past the pinch rollers 22. A second paper path P2 is provided for feeding paper continuously through a rear paper feed inlet opening, along a radially contoured side of paper pan 18 engaging the main drive roller 16 and past the main drive roller 16 for printing by printhead 12 and exit past the pinch rollers 22. The third paper path P3 is illustrated, for example, for feeding cut paper through a top inlet feed opening into the pan 18 about the main drive roller 16 and past the printhead 12 for exit through the pinch rollers 22. As illustrated, each of the paper paths P1 and P2, as well as cut paper path P3, provide selected paths for the paper to be fed past the printhead. Obviously, however, only one paper path is used at any one time for supplying paper to the printhead.

Figure 2:
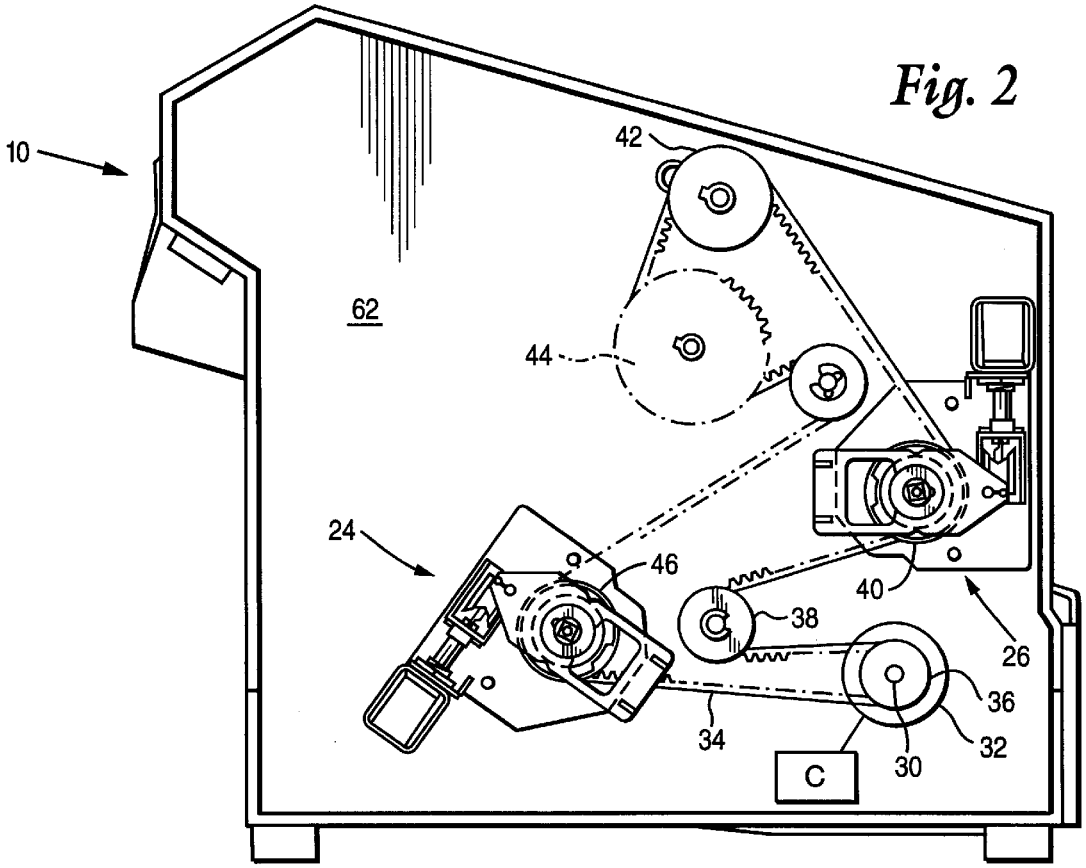
FIG. 2 is an enlarged schematic illustration of the printer of FIG. 1 illustrating clutches for rotational synchronization according to the present invention.

Tractor sets are provided for the non-cut paper paths P1 and P2. The tractor sets, designated TR1 and TR2, are conventional in construction and further description thereof is not believed necessary. Suffice to say, the tractor sets each comprise a set of sprockets which are driven from a drive gear whereby continuous webs of paper may be separately driven by tractor sets TR1 and TR2 past the printhead 12. With reference to FIG. 2, each of the tractor sets is provided with a clutch, generally designated 24 and 26. For example, to drive a continuous web of paper along paper path P1 through tractor set TR1 for printing by printhead 12, clutch 24 is engaged to drive the sprockets of tractor TR1 whereby the continuous web of paper is fed past printhead 12. Similarly, to drive the continuous web of paper along paper path P2, clutch 26 is engaged to drive tractor TR2 whereby the sprockets drive the paper along path P2 through the printhead 12. Obviously, when the clutch 24 is engaged, clutch 26 is disengaged and, conversely, when clutch 26 is engaged, clutch 24 is disengaged.

As illustrated in FIG. 2, printer 10 generally includes a main drive shaft 30 driven by a stepper motor 32 under the control of a controller C. An endless cog or timing belt 34 engages the pulley 36 on motor shaft 30 to drive the timing belt 34. Belt 34 extends around an idler pulley 38, about a pulley 40 associated with clutch 26, about a pulley 42 for driving the exit pinch rollers 22, about a main drive pulley 44 for driving the main drive roller 16, about a pulley 46 forming part of clutch 24 and, finally, returning to the pulley 36 of the motor 32. Consequently, it will be appreciated from a review of FIG. 2, that the timing belt 34 is driven by the stepper motor 32 and that, upon engagement of one or the other of clutches 24 and 26, the corresponding tractor set TR1 or TR2 will be driven to drive paper along the selected path P1 or P2. The stepper motor 36 is under the control of a controller C which may comprise a microprocessor with associated memory and appropriate software, controls the function of the machine.

Referring now to FIGS. 3–6, the clutches 24 and 26 are identical to one another and the following description of clutch 24 is also applicable to clutch 26. Clutch 24 has an outer rotational element including a hub 50 having a central square opening 52 for engaging a corresponding square upper portion 54 of a cylindrical drive shaft 56 which terminates at its lower end in a knurled cylindrical portion 58. Clutch 24 is carried on a base support 60 secured to a side wall 62 (FIG. 2) of the printer 10. The drive mechanism illustrated in FIG. 2 including the timing belt and clutches is disposed between an outer wall and an inner wall along one side of the printer with the knurled end 58 of the output shaft 56 lying on the opposite side of wall 62 from support 60. The end of shaft 56 terminates in an output gear 64 which engages directly or through one or more idler gears the tractor TR1. Clutch 26 is similarly constructed and its output gear likewise engages directly or through one or more idler gears the tractor TR2.

Figure 3:
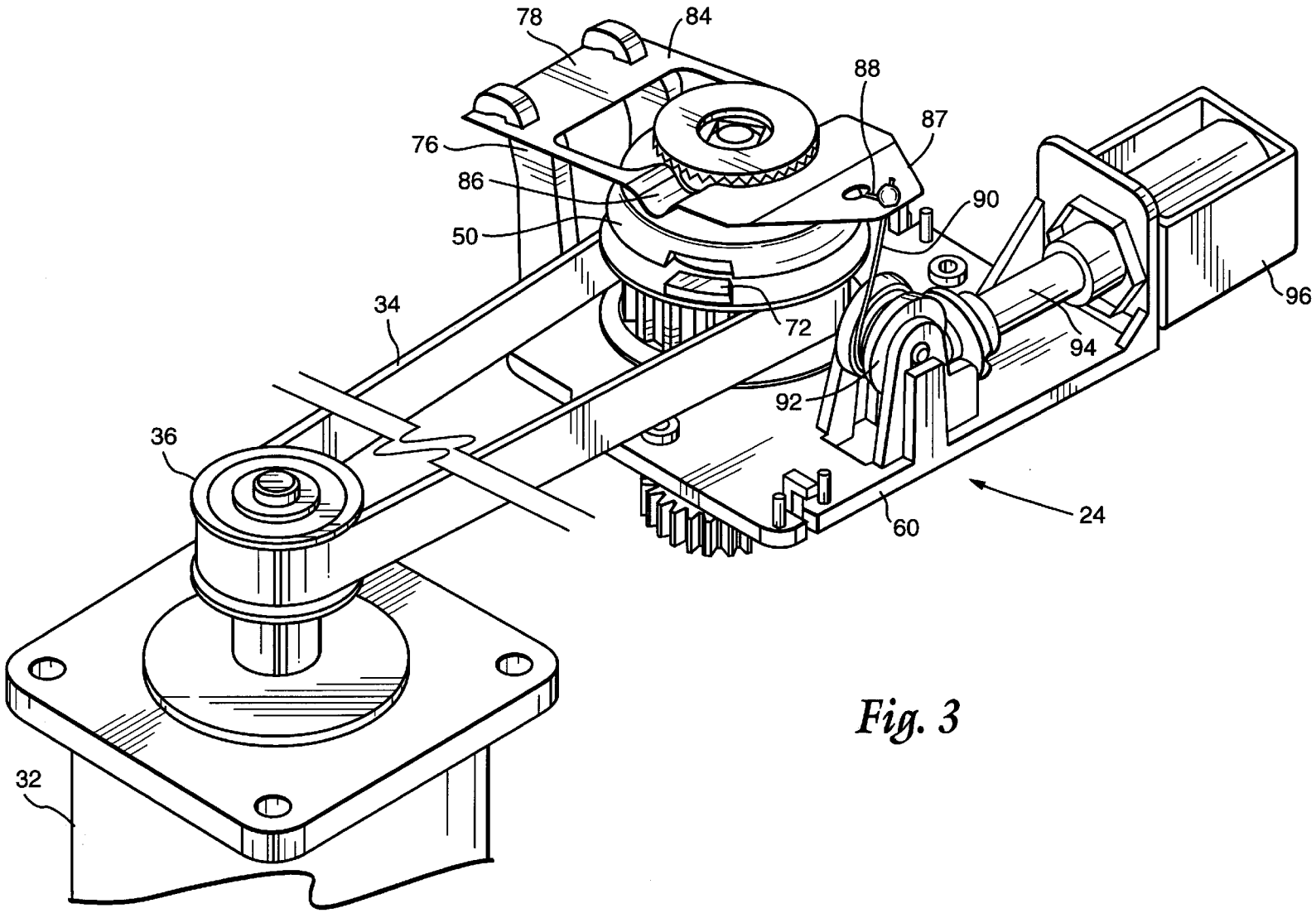
FIG. 3 is a perspective view of the clutch illustrated in FIG. 2.
Figure 4:
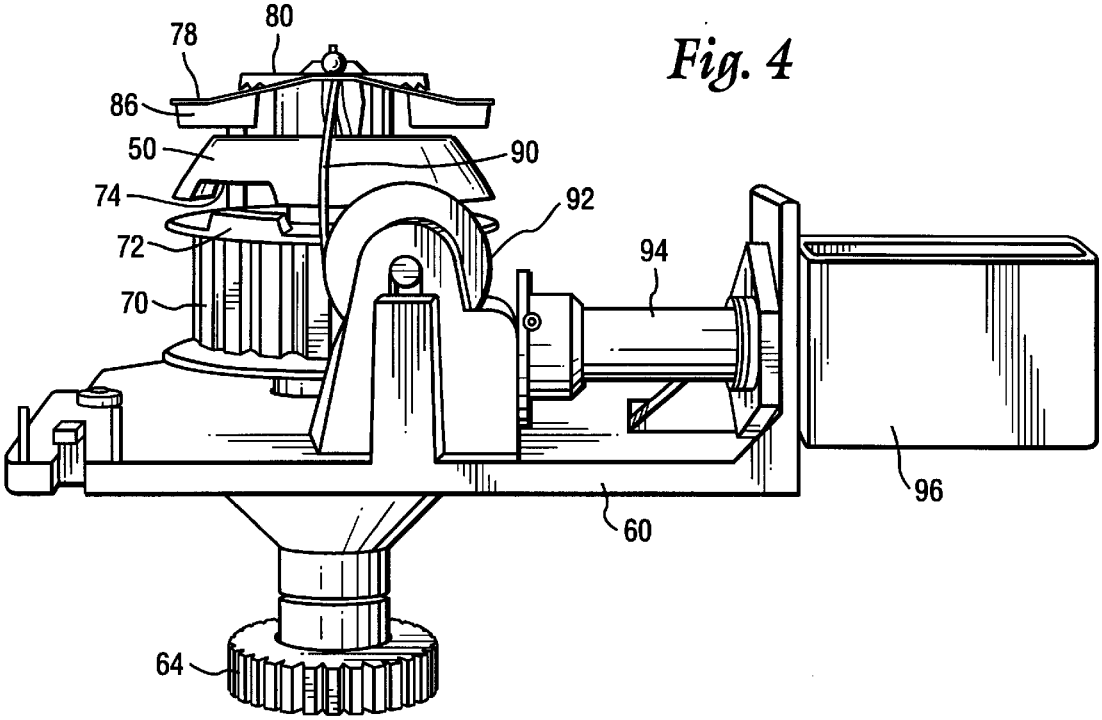
FIGS. 4 and 5 are side perspective views of the clutch hereof illustrated in the disengaged and engaged positions, respectively.
Figure 5:
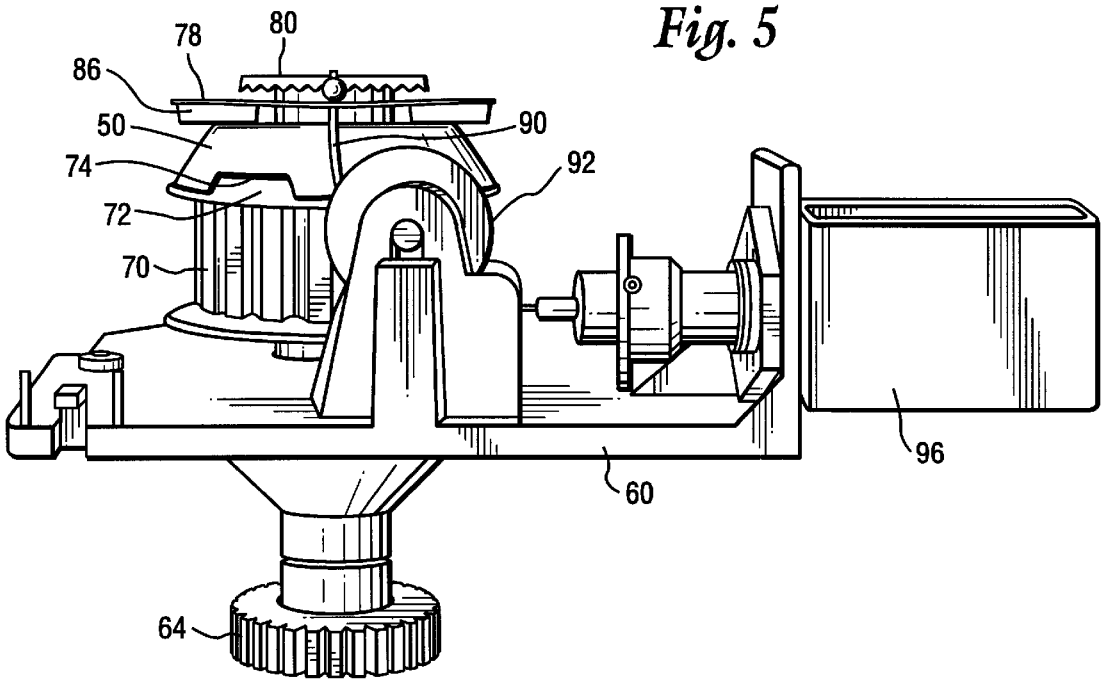
Figure 6:
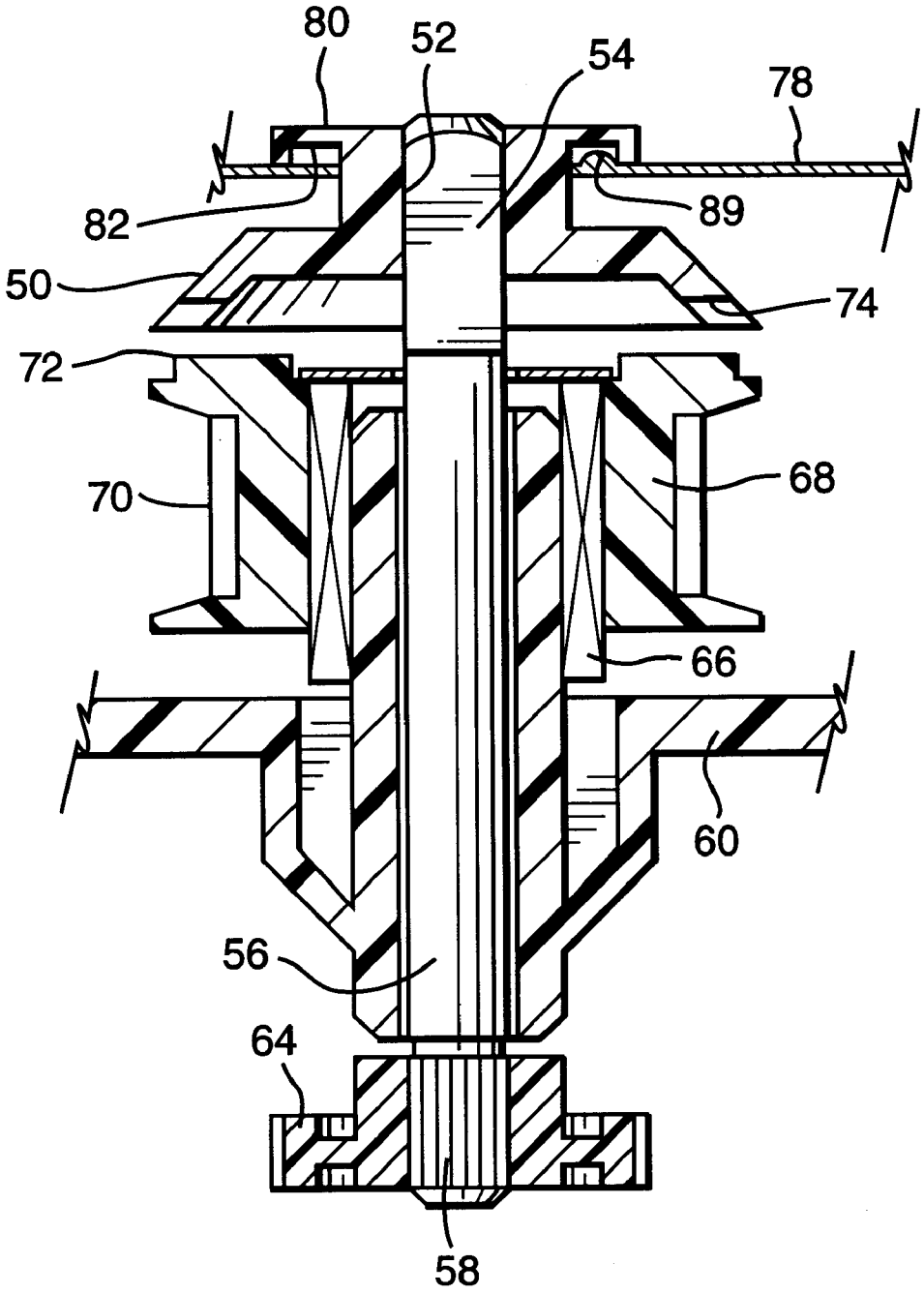
FIG. 6 is an enlarged fragmentary cross-sectional view through the body of the clutch.

Clutch 24 also includes a bearing 66 carried by support 60 and on which bearing is mounted a freely rotatable or free-wheeling pulley or input element 68 having cog teeth 70 for engagement with the teeth of timing or cog belt 34. An upper face, as illustrated in FIGS. 3 and 6, of the pulley 68 has a pair of axially extending teeth or projections 72 tapered along their sides as illustrated in FIGS. 4 and 5 and disposed 180° apart. The lower peripheral margin of hub 50 has a pair of output element or recesses 74, likewise disposed 180° apart and complementary shaped and sized for receiving the teeth 72, respectively, upon engagement of the clutch.

Referring to FIG. 3, support 60 includes a pair of upstanding legs 76 which mount a flat leaf spring 78. Hub 50 also includes along its upper surface a radially outwardly extending annular projection 80 having a plurality of serrations or downwardly projecting ribs 82 along its undersurface. Spring 78 has a pair of spaced legs 84 which straddle hub 50 below annular projection 80. Spring 78 is biased to upwardly engage along the underside of annular projection 80. Along legs 84, leaf spring 78 has downwardly extending protuberances 86 for engaging along an upper annular surface of the lower portion of hub 50. The protuberances 86, as illustrated in FIGS. 4 and 5, lie on opposite sides of hub 50 and shaft 56. Spring 78 terminates at its distal end in a pull tab 87.

Referring to FIGS. 3, 4 and 5, the pull tab 87 has a slot 88 which receives the distal end of a flexible pull wire 90. Wire 90 extends around a pulley 92 mounted on support 60 and is secured at its proximal end to a plunger 94 of a solenoid 96. With the end of pull wire 90 secured to the tab 87, it will be appreciated that actuation of solenoid 96 retracts the plunger 94 whereby pull wire 90 is retracted and the distal end of wire 90 deflects tab 87 downwardly against the bias of spring 78. By deflecting the spring downwardly, the protuberances 86 displace hub 50 axially downwardly along shaft 56 such that teeth 72 of the continuously driven pulley 70 engage in the slots 74 of the hub. When so engaged, the pulley 70, driven by the timing belt 34, is engaged with the hub 50, enabling pulley 70 to drive the hub 50, shaft 56 and output gear 64 of the clutch and, hence, the tractor coupled thereto, thereby driving the paper along the corresponding paper path. Upon deactuation of solenoid 96, the plunger 94 extends and the return bias of spring 78 raises the hub 50 along the square end of shaft 56 to withdraw hub 50 from engagement with pulley 70. Consequently, spring 78 disengages the clutch and hence disengages the stepper motor, timing belt and pulley from the tractor which drives the paper along the paper path associated with that clutch.

In operation, it will be appreciated that the stepper motor under control of controller C intermittently drives the timing belt 34 and the pulley 70 associated with each of the clutches 24 and 26. When neither clutch is engaged, paper cannot be fed through the paper paths P1 and P2, for example, when cut sheet paper is being supplied along paper path P3. When it is desired to continuously print, for example, along paper path P1, clutch 24 is engaged. To accomplish this, the solenoid 96 is actuated by the controller to displace spring 78 against its bias and axially displace hub 50 into engagement with pulley 70. By engaging hub 50 with driven pulley 70 and starting the stepper motor 32, motor 32 drives the output gear 64 through pulley 70, hub 50 and shaft 56 whereby the sprockets on the tractor set TR1 drive the web of paper through the printhead and along path P1. The stepper motor then stops, a line is printed, and the stepper motor starts again to advance the paper for printing the next line. During this time, the solenoid 96 associated with the second clutch 26 remains unactuated and its spring bias maintains hub 50 elevated from the associated pulley 70, maintaining pulley 70 disengaged from the hub 50. As seen in FIG. 6, a projection or dimple 89 is provided on the upper surface of the spring underlying teeth 82 of the annular projection 80 of hub 50. When dimple 89 engages ribs 82, the hub 50, shaft 56 and output gear 64 are detented and maintained in approximate position in which these drive elements were previously disengaged.

When the operator controls the software to provide paper along paper path P2, clutch 24 is disengaged and clutch 26 is engaged. To disengage clutch 24, solenoid 26 is deactuated, raising hub 50 from engagement with pulley 70. Upon deactuation of clutch 24 and its solenoid 96, controller C, however, remembers the rotational step position of the stepper motor 32. Consequently, when the operator or the software returns the printer to a condition where paper selected for supply along path P1 to the printer, the stepper motor is controlled by controller C to return to the previous rotational position where the clutch was disengaged. Consequently, at the instant the solenoid 96 is energized, clutch 24 engages at the same paper location as when disengaged and without cumulative error in the system.

To compensate for any slight misalignment due to small movements, for example, an angular degree or so of the clutch hub and guarantee engagement to previous rotational positions, the stepper motor 32 is controlled to position the pulley 70 a few angular degrees back or behind from where the clutch was disengaged before energizing the solenoid to engage the clutch. Once the solenoid is energized and as the stepper motor drives forwardly driving the pulley, the pulley 70 will move forwardly until the teeth 72 align with the recesses or apertures 74, at which time the spring 78 engages the hub against the pulley. At that time, the clutch is engaged and synchronization between the stepper motor and the position is achieved without any cumulative error in the system.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A printer comprising:

a printer housing having a printhead and at least two paper paths for selectively feeding paper in said paper paths to said printhead;

a drive mechanism for feeding paper along one of said paths, including a stepper motor, a timing belt driven by said stepper motor, a clutch coupled to said timing belt, and a paper-engaging feed device coupled to said clutch, said clutch being operable in a clutch-engaged position to drive said paper-engaging feed device to feed paper along said one paper path in response to rotation of said stepper motor, and in a clutch-disengaged position precluding the stepper motor and timing belt from driving said paper-engaging feed device;

a clutch actuator for engaging and disengaging said clutch;

a controller for said stepper motor including a memory for remembering stepper motor rotational positions upon disengagement of said clutch and repositioning said stepper motor to a position enabling engagement of said clutch at the same rotational position of the stepper motor when the clutch was disengaged, thereby synchronizing the stepper motor and the position of the paper along said one path.

2. A printer according to claim 1 wherein the clutch is reengaged at identically the same rotational position of the stepper motor when the clutch was disengaged.

3. Apparatus according to claim 1 wherein the stepper motor under control of the controller is repositioned to a rotational position behind said rotational position of the stepper motor when the clutch was disengaged whereby, upon actuating said clutch, the stepper motor steps forwardly into the position enabling engagement of the clutch at substantially the same rotational position of the stepper motor when the clutch was disengaged, thereby ensuring engagement of the clutch.

4. Apparatus according to claim 1 wherein said clutch includes a pulley coupled to said timing belt, a drive shaft, a hub for coupling and decoupling said pulley and said drive shaft to one another, a spring for maintaining said hub decoupled from said drive shaft and a solenoid for displacing said spring to couple said hub and said drive shaft to one another.

5. Apparatus according to claim 1 wherein said paper-engaging feed device includes a tractor having sprockets for engaging marginal holes in the paper.

6. A method of operating a printer having at least two paper paths, comprising the steps of:

providing a clutch having rotational input and output elements;

repeatedly engaging and disengaging the input and output elements relative to one another for respectively feeding and discontinuing the feed of paper along one of said paths;

synchronizing the input and output rotational elements during repeated engagements thereof such that the clutch reengages the input and output elements at respective rotational positions corresponding to the rotational positions of the input and output elements when previously disengaged from one another;

the step of synchronization including rotating the input element to a rotational position corresponding to the rotational position thereof when the input element was previously disengaged from the output element;

providing solely a pair of diametrically opposite projections on one of said input and output elements and solely a pair of diametrically opposite recesses on another of said input and output elements; and engaging said projections in said recesses when said input element is rotated to said rotational position corresponding to the rotational position thereof when the input element was previously disengaged from the output element.

* * * * *